US008425006B2

(12) United States Patent
Mase et al.

(10) Patent No.: US 8,425,006 B2
(45) Date of Patent: Apr. 23, 2013

(54) IMAGE FORMING APPARATUS INCLUDING FIRST AND SECOND CARRIAGES WHICH ARE DETACHABLY ATTACHABLY TO EACH OTHER

(75) Inventors: Ryusuke Mase, Kanagawa (JP); Ichiro Komuro, Kanagawa (JP); Mamoru Yorimoto, Tokyo (JP); Shinichiro Naruse, Kanagawa (JP); Soichi Saiga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 12/957,622

(22) Filed: Dec. 1, 2010

(65) Prior Publication Data

US 2011/0134190 A1 Jun. 9, 2011

(30) Foreign Application Priority Data

Dec. 3, 2009 (JP) ..... 2009-275090

(51) Int. Cl.
*B41J 2/14* (2006.01)
*B41J 2/16* (2006.01)

(52) U.S. Cl.
USPC ..... 347/49; 347/20; 347/85

(58) Field of Classification Search ..... 347/14, 347/19, 20, 29, 37, 40, 43, 44, 49, 54, 84–87
See application file for complete search history.

(56) References Cited

U.S. PATENT DOCUMENTS 6,164,755 A * 12/2000 Yamamoto ..... 347/37
2010/0295897 A1 11/2010 Naruse et al.

FOREIGN PATENT DOCUMENTS

| | | |
|---|---|---|
| JP | 60-49973 | 3/1985 |
| JP | 2785031 | 5/1998 |
| JP | 3332661 | 7/2002 |
| JP | 3645012 | 2/2005 |

* cited by examiner

*Primary Examiner* — Juanita D Jackson
(74) *Attorney, Agent, or Firm* — Cooper & Dunham LLP

(57) ABSTRACT

An image forming apparatus including a first carriage having a recording head that ejects black liquid droplets and is movable in a main scanning direction, a second carriage having a recording head that ejects color liquid droplets and is detachably attachable to the first carriage to move in the main scanning direction together with the first carriage while attached to the first carriage, and a cap member that caps the recording head of the second carriage while the first carriage is moving with the second carriage separated from the first carriage. Attachment and detachment of the second carriage to and from the first carriage are performed within a scanning range through which the first carriage is movable.

19 Claims, 7 Drawing Sheets

IMAGE FORMING APPARATUS INCLUDING FIRST AND SECOND CARRIAGES WHICH ARE DETACHABLY ATTACHABLY TO EACH OTHER

BACKGROUND

1. Technical Field

This disclosure relates generally to an image forming apparatus, and more particularly to an image forming apparatus using a recording head including a liquid ejection head that ejects liquid droplets.

2. Description of the Background

One example of related-art image forming apparatuses such as printers, copiers, plotters, facsimile machines, and multifunction devices having two or more of printing, copying, plotting, and facsimile functions is an inkjet recording device employing a liquid ejection recording method. The inkjet recording device includes a recording head that ejects droplets of a recording liquid such as ink onto a sheet of a recording medium while the sheet is conveyed to form an image on the sheet.

Examples of the inkjet recording device include a serial-type image forming apparatus, in which the recording head ejects liquid droplets while moving in a main scanning direction to form an image on the sheet as the sheet is moved in a sub-scanning direction perpendicular to the main scanning direction, and a line-type image forming apparatus equipped with a line-type recording head that ejects liquid droplets and does so without moving to form an image on the sheet as the sheet is moved in the sub-scanning direction.

A maintenance mechanism that maintains and recovers performance of the recording head is essential for the image forming apparatus employing the liquid ejection recording method. One of the functions of the maintenance mechanism is to discharge bubbles, foreign substances, coagulated ink, and so forth present in the recording head through nozzles in the recording head in order to prevent irregular ejection of the ink from the nozzles in the recording head.

In addition, a full-color image forming apparatus that forms full-color images using the liquid ejection recording method generally includes two separate recording heads, that is, a recording head that ejects black ink droplets (hereinafter referred to as the first recording head) and a recording head that ejects color ink droplets (hereinafter referred to as the second recording head). In such a full-color image forming apparatus, not only black ink but also color ink is ejected for maintenance of the recording heads even when monochrome printing is performed using only the first recording head, causing a waste of color ink and a concomitant cost increase.

In order to solve this problem, various techniques have been proposed. In one example, an image forming apparatus includes a scanning-type carrier which is moved reciprocally back and forth by a drive force; a first carriage that ejects black ink droplets and a second carriage that ejects color ink droplets, each detachably attachable to the carrier; a detector that detects that the carriages attached to the carrier passes through a certain reference position in a direction of movement of the carrier; and a control unit that controls movement of the carrier using as a reference a time when the detector detects the carriages.

Another example of an image forming apparatus includes carriages that eject black and color ink droplets, respectively, and a linking mechanism provided between the carriages.

In yet another approach, an image forming apparatus includes a driving head, a driven head coupled to the driving head, a first connection unit that connects the driving head and the driven head, a second connection unit that connects the driven head and a lateral plate of the apparatus, and so forth. While the driving head is moved reciprocally, the driven head coupled to the lateral plate is in a standby state. The driving head is moved to the driven head so that the driving head and the driven head are coupled to each other to reciprocally move together.

In still yet another example, an image forming apparatus includes first and second carriages detachably attachable to each other using an electromagnet. One of the first and second carriages is at a home position in a standby state while the other of the first and second carriages is moving reciprocally.

However, in the above-described image forming apparatuses, in which the carriages that respectively eject black and color ink droplets are coupled to each other in a main scanning direction with a connection unit such as the scanning-type carrier, the size of the image forming apparatus is increased in the main scanning direction by this arrangement.

FIG. 1 is a front view illustrating carriages that can be coupled to and separated from each other in a related-art image forming apparatus. The image forming apparatus includes a carriage 501 that ejects black ink droplets and a carriage 502 that ejects color ink droplets, each disposed in a main scanning direction. Each of the carriages 501 and 502 can be coupled to an intermediate scanning carrier 503 with rods 504A and 504B and grippers 505A and 505B, respectively, so that the carriages 501 and 502 are coupled to each other. Each of the grippers 505A and 505B is provided to the intermediate scanning carrier 503 and is detachably attachable to the rods 504A and 504B, respectively. When monochrome printing is performed using only the carriage 501, the carriage 502 is separated from the carriage 501 and the intermediate scanning carrier 503 as illustrated in FIG. 1. At this time, a distance a is maintained between the carriage 502 or a moisturizing mechanism 506 and a scanning range of the carriage 501 in order to prevent collision between the carriage 502 and the gripper 505B provided to the intermediate scanning carrier 503 coupled to the carriage 501, thereby increasing the width of the image forming apparatus by an amount equal to the distance $\alpha$.

SUMMARY

In this disclosure, a novel image forming apparatus including first and second carriages which are detachably attachable to each other is provided without increasing a width of the image forming apparatus.

In one illustrative embodiment, an image forming apparatus includes a first carriage having a recording head that ejects black liquid droplets and is movable in a main scanning direction, a second carriage having a recording head that ejects color liquid droplets and is detachably attachable to the first carriage to move in the main scanning direction together with the first carriage while attached to the first carriage, and a cap member that caps the recording head of the second carriage while the first carriage is moving with the second carriage separated from the first carriage. Attachment and detachment of the second carriage to and from the first carriage are performed within a scanning range through which the first carriage is movable.

In another illustrative embodiment, an image forming apparatus includes a first carriage having a recording head that ejects black liquid droplets and is movable in a main scanning direction, a second carriage having a recording head that ejects color liquid droplets and is detachably attachable to the first carriage to move in the main scanning direction together with the first carriage while attached to the first carriage, and a mechanism that holds the second carriage at a height such that the second carriage is not placed on the first carriage. The mechanism is movable downward to lower and dock the second carriage onto the first carriage and upward to lift and separate the second carriage from the first carriage.

Additional aspects, features, and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein like reference numerals designate identical or corresponding parts throughout the several views and wherein.

DETAILED DESCRIPTION OF THE ILLUSTRATIVE EMBODIMENTS

Figure 1:
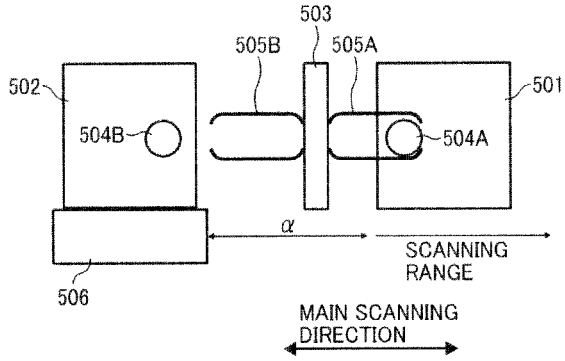
FIG. 1 RELATED ART
FIG. 1 is a front view illustrating carriages that can be coupled to and separated from each other in a related-art image forming apparatus.

In describing illustrative embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

Image forming apparatuses hereinafter described form an image on a recording medium, such as paper, string, fiber, cloth, lather, metal, plastics, glass, wood, and ceramics by ejecting liquid droplets onto the recording medium. In this specification, an image refers to both signifying images such as characters and figures, as well as a non-signifying image such as patterns. In addition, ink includes any material which is a liquid when ejected from the recording head, such as a DNA sample, a resist material, and a pattern material. Further, an image formed on the recording medium is not limited to a flat image, but also includes an image formed on a three-dimensional object, a three-dimensional image, and so forth.

Figure 2:
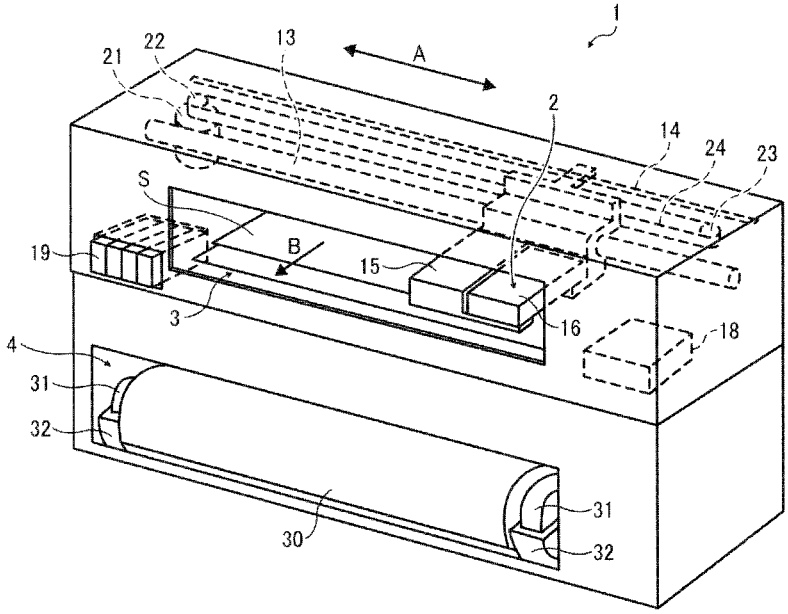
FIG. 2 is a perspective view illustrating an example of a configuration of an image forming apparatus according to illustrative embodiments.
Figure 3:
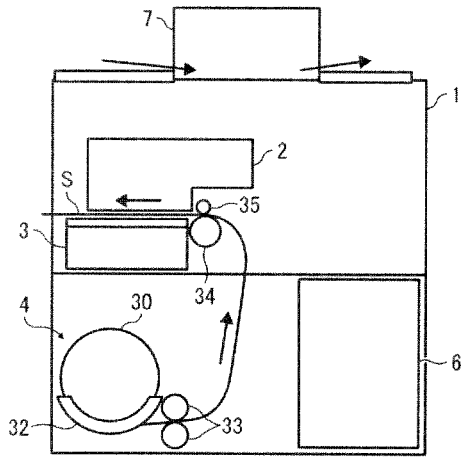
FIG. 3 is a vertical cross-sectional view illustrating the configuration of the image forming apparatus illustrated in FIG. 2.
Figure 4:
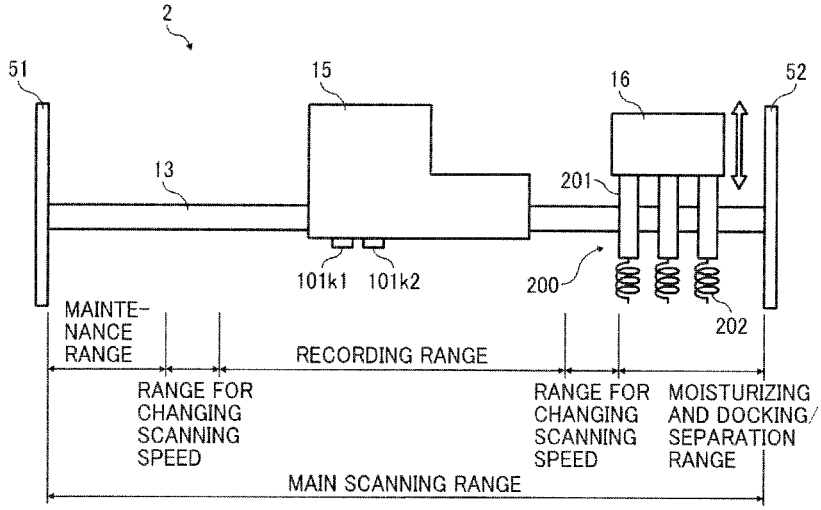
FIG. 4 is a front view illustrating a configuration of an image forming unit of the image forming apparatus illustrated in FIG. 2.

A description is now given of a configuration and operation of an inkjet recording device serving as an image forming apparatus 1 according to illustrative embodiments with reference to FIGS. 2 to 4. FIG. 2 is a perspective view illustrating an example of a configuration of the image forming apparatus 1. FIG. 3 is a vertical cross-sectional view illustrating the configuration of the image forming apparatus 1. FIG. 4 is a front view illustrating a configuration of an image forming unit 2 of the image forming apparatus 1.

The image forming apparatus 1 is a serial-type inkjet recording device, and includes the image forming unit 2, a sheet conveyance unit 3, a sheet roll storage 4, an electrical substrate storage 6, an image reading unit 7 provided at the top thereof, and so forth. It is to be noted that the image reading unit 7 is omitted in FIG. 2 for ease of illustration.

In the image forming unit 2, a guide rod 13 and a guide rail 14 are extended between lateral plates 51 and 52, and a first carriage 15 that ejects black ink droplets is slidably held by the guide rod 13 and the guide rail 14 in a direction indicated by a double-headed arrow A in FIG. 2 (hereinafter referred to as the main scanning direction). A second carriage 16 that ejects color ink droplets can be docked with and separated from the first carriage 15. It is to be noted that FIG. 2 illustrates a state in which the first and second carriages 15 and 16 are docked together, and FIG. 4 illustrates a state in which the first and second carriages 15 and 16 are separated from each other.

A main scanning mechanism that moves the first carriage 15 reciprocally in the main scanning direction includes a drive motor 21 positioned at one end of the image forming apparatus 1 in the main scanning direction, a drive pulley 22 driven by the drive motor 21, a driven pulley 23 provided at the other end of the image forming apparatus 1 in the main scanning direction, and a belt member 24 wound around the drive pulley 22 and the driven pulley 23. A tension spring, not shown, applies tension to the driven pulley 23 to separate the driven pulley 23 from the drive pulley 22. A part of the belt member 24 is fixed to a mount provided to a back surface of the first carriage 15 to guide the first carriage 15 in the main scanning direction.

An encoder sheet, not shown, is provided along the main scanning direction in order to detect a main scanning position of the first carriage 15. The encoder sheet is read by an encoder sensor, not shown, provided to the first carriage 15.

The first carriage 15 has a main scanning range through which it scans, and within this range is a recording range. A sheet S fed from a sheet roll 30 is intermittently conveyed to the recording range by the sheet conveyance unit 3 in a direction perpendicular to the main scanning direction indicated by an arrow B in FIG. 2 (hereinafter referred to as the sub-scanning direction).

An ink cartridge 19 that stores ink of a specific color, that is, yellow (Y), cyan (C), magenta (M), or black (K), to be supplied to sub-tanks included in recording heads provided to the first and second carriages 15 and 16, is detachably attached to the image forming apparatus 1 at the one end of the image forming apparatus 1 in the main scanning direction, that is, a portion outside the main scanning range of the first carriage 15. A maintenance mechanism 18 that performs maintenance and recovery of the recording heads is provided at the other end of the image forming apparatus 1 in the main scanning direction within the main scanning range of the first carriage 15.

The sheet roll 30 is set in the sheet roll storage 4 serving as a sheet feed unit. The sheet roll 30 having different widths can be set in the sheet roll storage 4. Flanges 31 are attached to both ends of a paper core of the sheet roll 30 and are placed on flange bearings 32, respectively. Support rollers, not shown, are provided to the flange bearings 32 to contact outer circumferential surfaces of the flanges 31, respectively, thereby rotating the flanges 31 to feed the sheet S from the sheet roll 30.

The sheet S fed from the sheet roll 30 set in the sheet roll storage 4 is conveyed by conveyance members such as a pair of rollers 33, a drive roller 34, and a driven roller 35 from the back to the front of the image forming apparatus 1 to reach the recording range. In monochrome printing, the first carriage 15 is moved in the main scanning direction, and the recording heads of the first carriage 15 are driven to eject black ink droplets onto the sheet S based on image data while the sheet S is intermittently conveyed in the sub-scanning direction. By contrast, in full-color printing, the first and second carriages 15 and 16 are docked together, and the recording heads of the first and second carriages 15 and 16 are together driven to eject ink droplets of the specified color onto the sheet S based on image data. Accordingly, a desired image is formed on the sheet S. The sheet S having the image thereon is cut to a predetermined length and is discharged to a discharge tray, not shown, provided to the front of the image forming apparatus 1.

Figure 5:
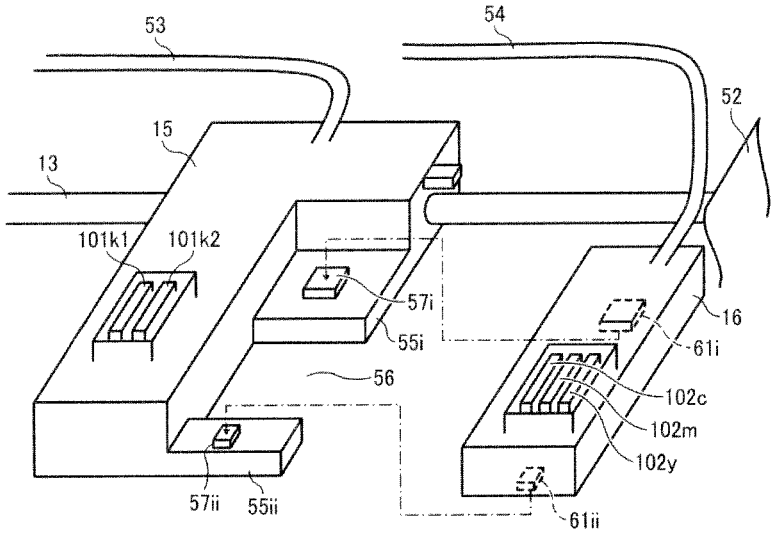
FIG. 5 is a perspective view illustrating an example of a configuration of first and second carriages separated from each other according to a first illustrative embodiment.
Figure 6:
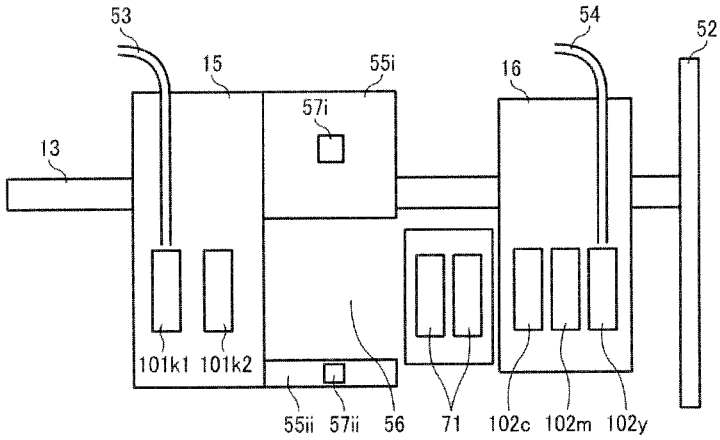
FIG. 6 is a top view illustrating the configuration of the first and second carriages separated from each other illustrated in FIG. 5.
Figure 7:
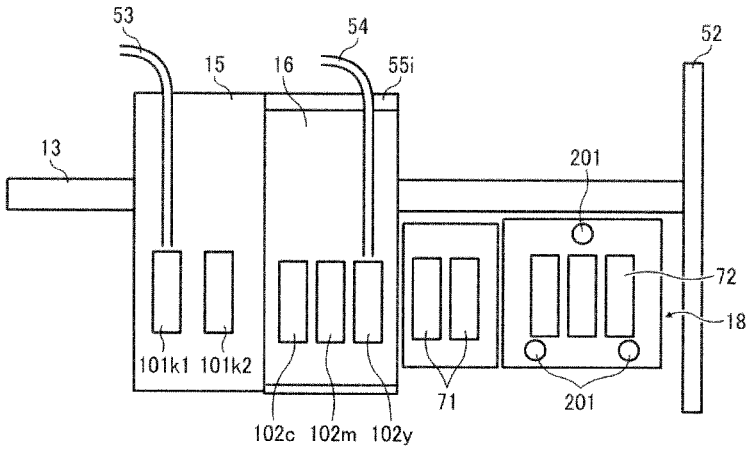
FIG. 7 is a top view illustrating an example of a configuration of the first and second carriages docked together according to the first illustrative embodiment.
Figure 8:
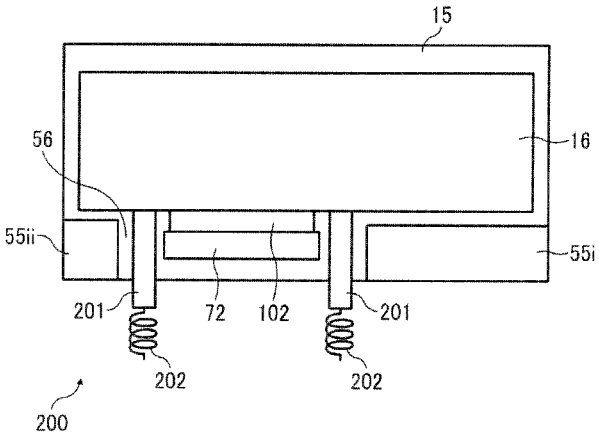
FIG. 8 is a side view illustrating the first and second carriages separated from each other.

A description is now given of a configuration of each of the first and second carriages 15 and 16 according to a first illustrative embodiment with reference to FIGS. 5 to 8. FIG. 5 is a perspective view illustrating an example of a configuration of the first and second carriages 15 and 16 separated from each other according to the first illustrative embodiment. FIG. 6 is a top view illustrating the first and second carriages 15 and 16 separated from each other as illustrated in FIG. 5. FIG. 7 is a top view illustrating an example of a configuration of the first and second carriages 15 and 16 docked together according to the first illustrative embodiment. FIG. 8 is a side view illustrating the first and second carriages 15 and 16 separated from each other.

The first carriage 15 includes first and second recording heads 101*k*1 and 101*k*2 (hereinafter collectively referred to as recording heads 101) each including a liquid ejection head that ejects black ink droplets. The first carriage 15 is moved reciprocally in the main scanning direction along the guide rod 13 by the carriage scanning mechanism. Black ink is supplied from the ink cartridge 19 provided to the image forming apparatus 1 to sub-tanks integrally formed with the recording heads 101 through a tube 53. Alternatively, replaceable ink cartridges may be attached to the recording heads 101.

The second carriage 16 includes recording heads 102*c*, 102*m*, and 102*y* (hereinafter collectively referred to as recording heads 102), each including a liquid ejection head that ejects ink droplets of a specific color, that is, cyan (C), magenta (M), or yellow (Y). The second carriage 16 is docked with the first carriage 15 so that the second carriage 16 is moved reciprocally in the main scanning direction by reciprocating movement of the first carriage 15. Ink of the specific color is supplied from the ink cartridge 19 provided to the image forming apparatus 1 to sub-tanks integrally formed with the recording heads 102 through a tube 54. Alternatively, replaceable ink cartridges may be attached to the recording heads 102.

The first carriage 15 has mounts 55*i* and 55*ii* (hereinafter collectively referred to as mounts 55) to place the second carriage 16 thereon, and a cutout 56 is formed between the mounts 55. When the second carriage 16 is placed on the mounts 55 to be docked with the first carriage 15, the color ink droplets are ejected from the recording heads 102 of the second carriage 16 onto the sheet S through the cutout 56, and caps of the maintenance mechanism 18 to be described in detail later are moved up and down within the cutout 56. The mounts 55 respectively have engaging members 57*i* and 57*ii* (hereinafter collectively referred to as engaging members 57) each separately engageable with engaging members 61*i* and 61*ii* (hereinafter collectively referred to as engaging members 61) provided to the second carriage 16.

It is to be noted that although, according to illustrative embodiments, the engaging members 57 of the first carriage 15 and the engaging members 61 of the second carriage 16 are formed of pairs of magnets, respectively, the configuration thereof is not limited thereto.

The maintenance mechanism 18 includes caps 71 that cap the recording heads 101 of the first carriage 15, caps 72 that cap the recording heads 102 of the second carriage 16, a wiper member, not shown, and so forth.

At the one end of the main scanning range where the maintenance mechanism 18 is positioned, a docking mechanism 200 that detachably couples the second carriage 16 to and from the first carriage 15 is provided. The docking mechanism 200 includes three pin members 201 that pass through the maintenance mechanism 18 to be moved up and down, and elastic members 202, which may be springs, that press the pin members 201 upward to hold the second carriage 16 at a height such that the second carriage 16 is not placed on the mounts 55 of the first carriage 15. When the pin members 201 are moved downward, the second carriage 16 is placed on the mounts 55 of the first carriage 15 to dock with the first carriage 15. By contrast, when the pin members 201 are moved upward by the elastic members 202, the second carriage 16 is lifted to be separated from the first carriage 15.

As described above, the recording heads 102 of the second carriage 16 and the pin members 201 of the docking mechanism 200 are accommodated within the cutout 56 formed between the mounts 55 of the first carriage 15, thereby preventing collision against the first carriage 15.

Docking and separation of the second carriage 16 to and from the first carriage 15 are performed from a direction other than the main scanning direction, that is, a vertical direction perpendicular to the main scanning direction according to illustrative embodiments. As shown in FIG. 4, docking and separation of the second carriage 16 to and from the first carriage 15 are performed within the main scanning range of the first carriage 15.

Accordingly, a width of the image forming apparatus 1 in the main scanning direction can be shortened compared to a configuration in which first and second carriages are docked and separated with and from each other in the main scanning direction with intermediate members provided therebetween. As a result, the first and second carriages 15 and 16 are smoothly docked and separated with and from each other in the downsized image forming apparatus 1.

Figure 9:
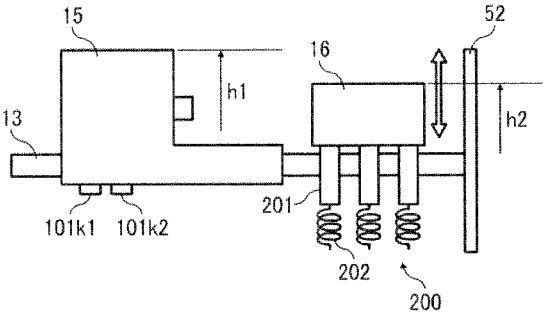
FIG. 9 is a front view illustrating the relative heights of the first and second carriages.

The relative heights of the first and second carriages 15 and 16 are described in detail below with reference to FIG. 9. FIG. 9 is a front view illustrating the relative heights of the first and second carriages 15 and 16.

The highest position h2 of the second carriage 16 from the center of a cross-section of the guide rod 13 is kept lower than the highest position h1 of the first carriage 15 from the center of a cross-section of the guide rod 13 regardless of docking and separation of the second carriage 16 to and from the first carriage 15. Accordingly, the height of the image forming apparatus 1 can be reduced.

Figure 10:
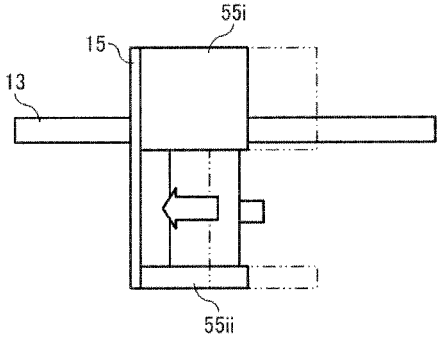
FIG. 10 is a top view illustrating a configuration of a first carriage according to a second illustrative embodiment.

A description is now given of a second illustrative embodiment of the present invention. FIG. 10 is a top view illustrating a configuration of the first carriage 15 according to the second illustrative embodiment.

In the second illustrative embodiment, the mounts 55 are movably provided to the first carriage 15 in the main scanning direction. Specifically, the mounts 55 can be moved between positions indicated by broken lines and positions indicated by solid lines, respectively, in FIG. 10 in the main scanning direction. As a result, when the second carriage 16 is docked with the first carriage 15, the mounts 55 are moved to the positions indicated by the broken lines in FIG. 10, respectively. By contrast, when the second carriage 16 is separated from the first carriage 15, the mounts 55 are moved to the positions indicated by the solid lines in FIG. 10, respectively, to be accommodated within the first carriage 15.

Accordingly, the configuration for docking and separating the first and second carriages 15 and 16 with and from each other and for positioning the first and second carriages 15 and 16 upon docking and separation can be simplified.

Figure 11:
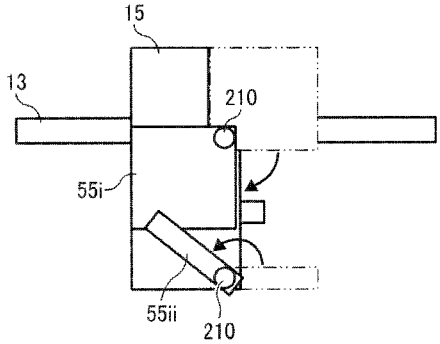
FIG. 11 is a top view illustrating a configuration of a first carriage according to a third illustrative embodiment.

A description is now given of a third illustrative embodiment of the present invention. FIG. 11 is a top view illustrating a configuration of the first carriage 15 according to the third illustrative embodiment.

In the third illustrative embodiment, the mounts 55 are rotatably provided to the first carriage 15 around pivots 210, respectively, so that the mounts 55 can be moved between positions indicated by broken lines and positions indicated by solid lines, respectively, in FIG. 11. When the second carriage 16 is docked with the first carriage 15, the mounts 55 are moved to the positions indicated by the broken lines in FIG. 10, respectively. By contrast, when the second carriage 16 is separated from the first carriage 15, the mounts 55 are moved to the positions indicated by the solid lines in FIG. 10, respectively, to be accommodated within the first carriage 15.

Accordingly, positioning of the first and second carriages 15 and 16 in the main scanning direction upon docking and separation of the first and second carriages 15 and 16 can be more easily performed.

Figure 12:
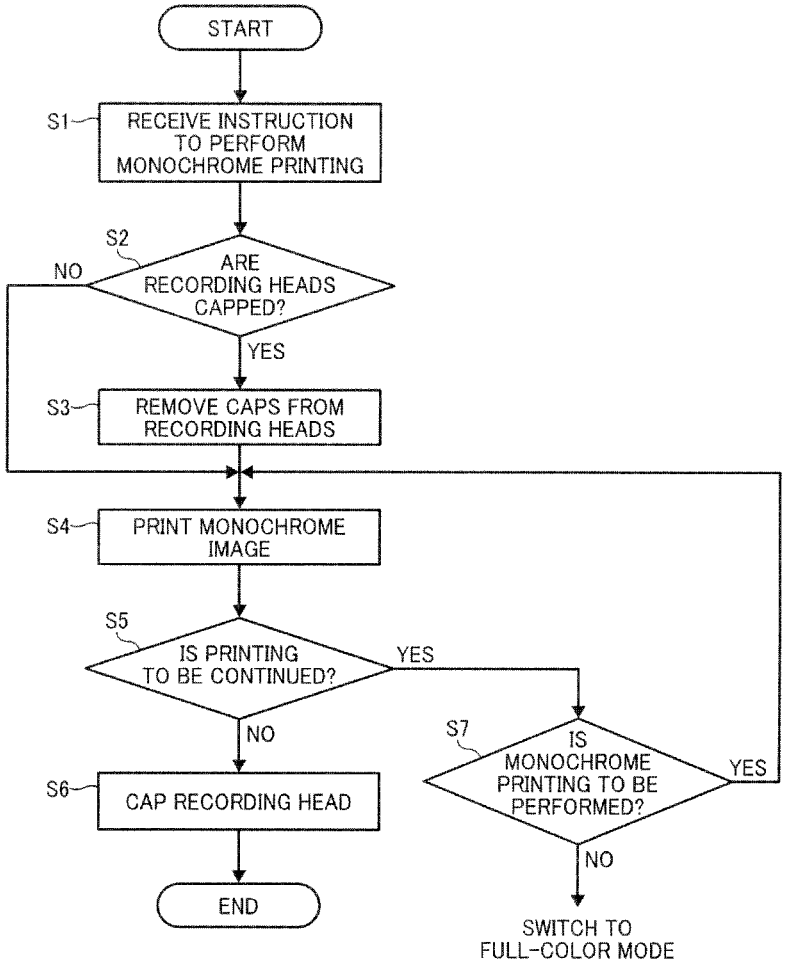
FIG. 12 is a flowchart illustrating steps in a process of performing monochrome printing using only the first carriage.

A description is now given of monochrome printing performed using only the first carriage 15 with reference to FIG. 12. FIG. 12 is a flowchart illustrating steps in a process of monochrome printing using only the first carriage 15.

Upon receiving an instruction to perform monochrome printing at step S1, whether or not the recording heads 101 of the first carriage 15 are capped is determined at S2. When the recording heads 101 are capped (YES at S2), the process proceeds to S3 to remove the caps 71 from the recording heads 101, and then monochrome printing is performed at S4. When the recording heads 101 are not capped (NO at S2), the process proceeds directly to S4 to perform monochrome printing. At S5, whether or not to continue printing is confirmed. When printing is to be continued (YES at S5), the process proceeds to S7 to determine whether or not monochrome printing is to be performed. When monochrome printing is to be performed (YES at S7), the process returns to S4 to perform monochrome printing. When full-color image printing is to be performed (NO at S7), a print mode is switched to a full-color mode to perform docking of the first and second carriages 15 and 16 and so forth. By contrast, when printing is not to be continued (NO at S5), the process proceeds to S6 to move the first carriage 15 to a capping position to cap the recording heads 101 of the first carriage 15 with the caps 71 so that monochrome printing is finished.

Figure 13:
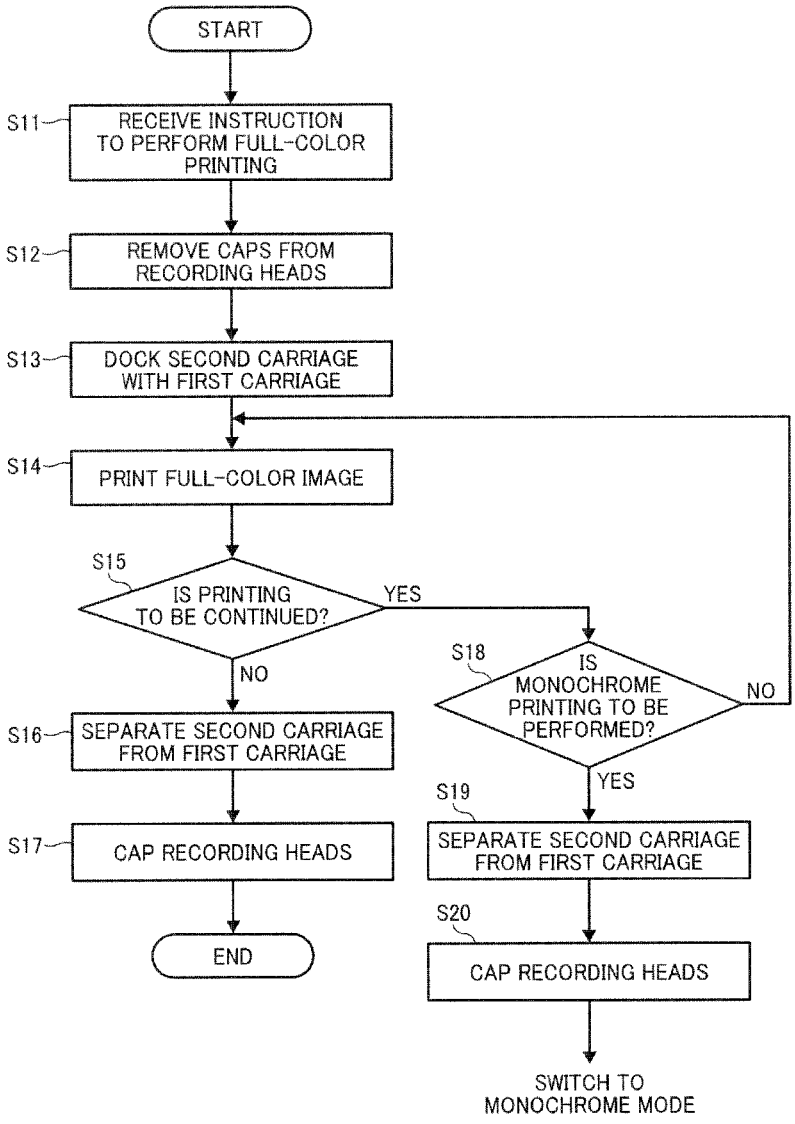
FIG. 13 is a flowchart illustrating steps in a process of performing full-color printing using both of the first and second carriages.

A description is now given of full-color printing performed using both of the first and second carriages 15 and 16 with reference to FIG. 13. FIG. 13 is a flowchart illustrating steps in a process of full-color printing using both of the first and second carriages 15 and 16.

Upon receiving an instruction to perform full-color image printing at step S11, at S12 the caps 71 and 72 are removed from the recording heads 101 and 102 of the first and second carriages 15 and 16, respectively. At S13, the first carriage 15 is moved to a docking position and the second carriage 16 is lowered so that the second carriage 16 is docked with the first carriage 15. At S14, the first carriage 15 with which the second carriage 16 is docked is moved reciprocally to perform full-color printing. At S15, whether or not to continue printing is confirmed. When printing is to be continued (YES at S15), the process proceeds to S18 to determine whether or not monochrome printing is to be performed. When monochrome printing is to be performed (YES at S18), the process proceeds to S19 to separate the second carriage 16 from the first carriage 15. At S20, the second carriage 16 is moved to a capping position to cap the recording heads 102 of the second carriage 16 with the caps 72, and the print mode is switched to a monochrome mode to perform monochrome printing. When full-color printing is to be continued (NO at S18), the process returns to S14 to perform full-color printing. By contrast, when printing is not to be continued (NO at S15), the process proceeds to S16 to separate the second carriage 16 from the first carriage 15. At S17, the recording heads 101 of the first carriage 15 and the recording heads 102 of the second carriage 16 are capped with the caps 71 and 72, respectively, so that printing is finished.

As can be appreciated by those skilled in the art, numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese Patent Application No. 2009-275090, filed on Dec. 3, 2009 in the Japan Patent Office, which is hereby incorporated herein by reference in its entirety.

What is claimed is:

1. An image forming apparatus comprising:

a first carriage having a recording head that ejects black liquid droplets and is movable in a main scanning direction;

a second carriage having a recording head that ejects color liquid droplets and is detachably attachable to the first carriage to move in the main scanning direction together with the first carriage while attached to the first carriage; and a cap member that caps the recording head of the second carriage while the first carriage is moving with the second carriage separated from the first carriage, attachment and detachment of the second carriage to and from the first carriage being performed within a scanning range through which the first carriage is movable, wherein the second carriage is attached to and detached from the first carriage in a direction other than the main scanning direction.

2. The image forming apparatus according to claim 1, wherein the first carriage further comprises mounts to place the second carriage thereon.

3. The image forming apparatus according to claim 2, wherein the mounts are movable within the scanning range in the main scanning direction.

4. The image forming apparatus according to claim 2, wherein the mounts are movable in a direction other than the main scanning direction.

5. The image forming apparatus according to claim 2, wherein a cutout is formed between the mounts.

6. The image forming apparatus according to claim 2, wherein the mounts are disposed parallel to a sub-scanning direction perpendicular to the main scanning direction.

7. The image forming apparatus according to claim 2, wherein a space through which the color liquid droplets are ejected from the recording head of the second carriage onto a recording medium is formed between the mounts.

8. An image forming apparatus comprising:

a first carriage having a recording head that ejects black liquid droplets and is movable in a main scanning direction;

a second carriage having a recording head that ejects color liquid droplets and is detachably attachable to the first carriage to move in the main scanning direction together with the first carriage while attached to the first carriage; and a cap member that caps the recording head of the second carriage while the first carriage is moving with the second carriage separated from the first carriage, attachment and detachment of the second carriage to and from the first carriage being performed within a scanning range through which the first carriage is movable, wherein the highest position of the second carriage is lower than the highest position of the first carriage regardless of attachment and detachment of the second carriage to and from the first carriage.

9. The image forming apparatus according to claim 8, wherein the first carriage further comprises mounts to place the second carriage thereon, and the mounts are movable in a direction other than the main scanning direction.

10. The image forming apparatus according to claim 8, wherein the first carriage further comprises mounts to place the second carriage thereon, and the mounts are disposed parallel to a sub-scanning direction perpendicular to the main scanning direction.

11. The image forming apparatus according to claim 8, wherein the first carriage further comprises mounts to place the second carriage thereon, and a space through which the color liquid droplets are ejected from the recording head of the second carriage onto a recording medium is formed between the mounts.

12. An image forming apparatus comprising:

a first carriage having a recording head that ejects black liquid droplets and is movable in a main scanning direction;

a second carriage having a recording head that ejects color liquid droplets and is detachably attachable to the first carriage to move in the main scanning direction together with the first carriage while attached to the first carriage; and a mechanism that holds the second carriage at a height such that the second carriage is not placed on the first carriage, the mechanism movable downward to lower and dock the second carriage onto the first carriage and upward to lift and separate the second carriage from the first carriage.

13. The image forming apparatus according to claim 12, wherein the mechanism comprises:

a vertically movable pin member; and an elastic member that moves the pin member upward to lift and separate the second carriage from the first carriage and downward to lower and dock the second carriage onto the first carriage.

14. The image forming apparatus according to claim 13, wherein the elastic member is a spring.

15. The image forming apparatus according to claim 12, wherein the highest position of the second carriage is lower than the highest position of the first carriage regardless of attachment and detachment of the second carriage to and from the first carriage.

16. The image forming apparatus according to claim 12, wherein the first carriage further comprises mounts to place the second carriage thereon.

17. The image forming apparatus according to claim 16, wherein the mounts are movable in a direction other than the main scanning direction.

18. The image forming apparatus according to claim 16, wherein the mounts are disposed parallel to a sub-scanning direction perpendicular to the main scanning direction.

19. The image forming apparatus according to claim 16, wherein a space through which the color liquid droplets are ejected from the recording head of the second carriage onto a recording medium is formed between the mounts.

* * * * *